United States Patent [19]

Brown

[11] Patent Number: 4,506,993

[45] Date of Patent: Mar. 26, 1985

[54] RECTANGULAR FRAMED ADVERTISING DISPLAY CLOCK

[76] Inventor: John M. Brown, 2600 Lockheed Way, Carson City, Nev. 89701

[21] Appl. No.: 531,455

[22] Filed: Sep. 12, 1983

[51] Int. Cl.[3] ..... G04B 37/00; G04B 19/14

[52] U.S. Cl. ..... 368/314; 368/236; 368/276

[58] Field of Search ..... 368/276, 223, 227, 314, 368/296, 228, 232, 236

[56] References Cited

U.S. PATENT DOCUMENTS

| | | | |
|---|---|---|---|
| 134,168 | 12/1872 | Roberts | 368/276 |
| 2,009,209 | 7/1935 | Scantlebury | 368/227 |
| 2,201,809 | 5/1940 | Brown | 368/227 |
| 2,812,421 | 11/1957 | Archer | 368/276 |
| 3,270,201 | 8/1966 | Hardesty | 368/227 |
| 3,283,496 | 11/1966 | Hohenthaner | 368/236 |
| 3,715,882 | 2/1973 | Ohde | 368/276 |

FOREIGN PATENT DOCUMENTS 2365010 4/1984 Fed. Rep. of Germany ..... 368/234

*Primary Examiner*—Bernard Roskoski

*Attorney, Agent, or Firm*—Keith D. Beecher

[57] ABSTRACT

A clock which is intended for use in soda fountains, restaurants, bars and other places of business as an advertising display, and which may be illuminated. The clock comprises a rectangular-shaped rigid frame, a translucent thin plastic panel constituting a clock face which is mounted in the frame and which extends across the area circumscribed by the frame, the thin panel being held in place by integral lugs which fit into slots in the frame, and a transparent plastic cover mounted on the frame in front of the clock face. In one embodiment the drive motor for the clock is mounted on the rear side of the plastic panel. In a second embodiment the drive motor, together with an illumination source for the translucent panel, are mounted in a housing which is supported on the rear side of the frame behind the thin plastic panel.

6 Claims, 4 Drawing Figures

RECTANGULAR FRAMED ADVERTISING DISPLAY CLOCK

BACKGROUND OF THE INVENTION

The objective and intendment of the present invention is to provide a simple and inexpensive, and yet attractive clock that is intended for use in retail outlets for advertising display purposes. The clock of the invention is formed primarily of three molded plastic parts which are held together by lugs so as to be easy to assemble and easy to disassemble. The thin plastic panel may be translucent, and in one embodiment a light source is mounted behind the panel to illuminate the panel. A space is provided on the panel for an advertising message, which may include a logo, which also is illuminated in the embodiment referred to above.

DETAILED DESCRIPTION OF THE ILLUSTRATED EMBODIMENTS

Figure 1:
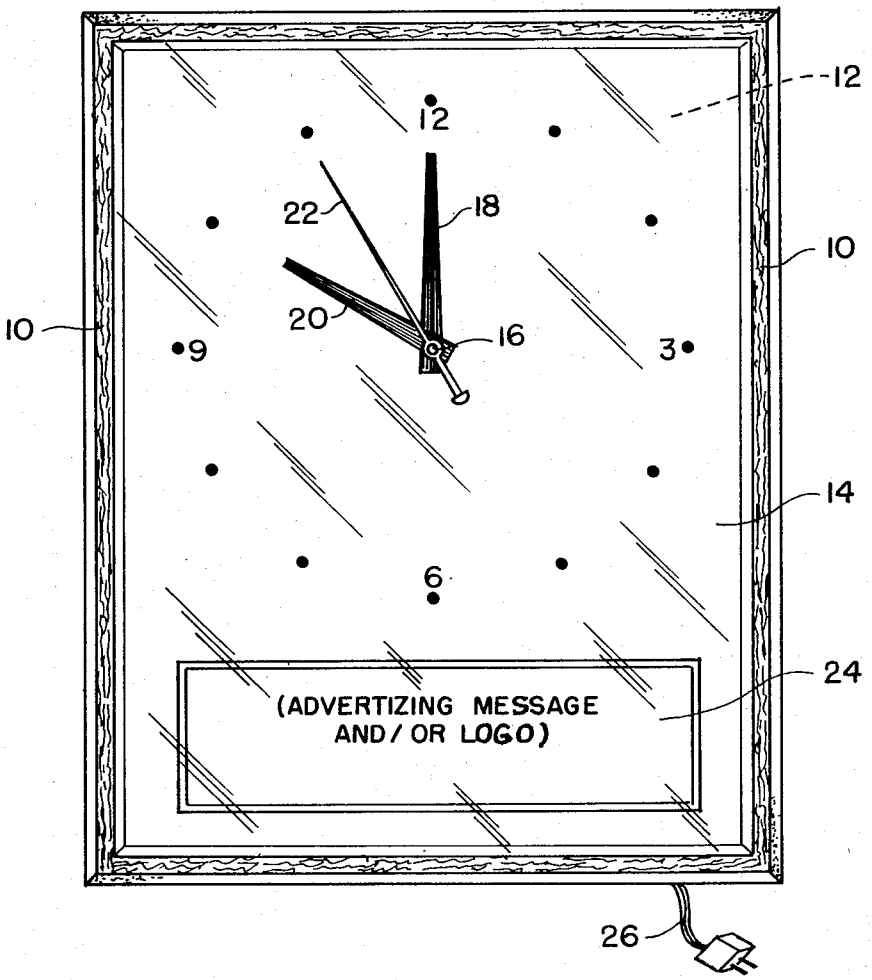
FIG. 1 is a representation of the front of the clock of the invention.

The front of the clock in both embodiments is the same, and is represented in the view of FIG. 1. As shown in FIG. 1, the clock includes a rigid frame 10 which may be formed of appropriate plastic material, and which may have a wood grain formed therein for decorative purposes.

A resilient plastic panel 12 is mounted in the frame 10, and a transparent cover 14 formed, for example, of acrylic plastic, or other appropriate material is mounted in the frame in front of the panel 12. A drive motor for the clock is mounted behind the panel 12, as will be described, and the motor includes a shaft 16 which extends through a hole in the panel.

An hour hand 18 and minute hand 20 are mounted on the shaft, as well as a second hand 22. Appropriate clock indicia are formed on the front face of panel 12, and the hands 18, 20 and 22 operate in conjunction with the indicia to indicate time. An area 24 is provided at the lower portion of the front face of panel 12 for an appropriate advertising message. An electric cord 26 is provided for energizing the clock motor.

Figure 2:
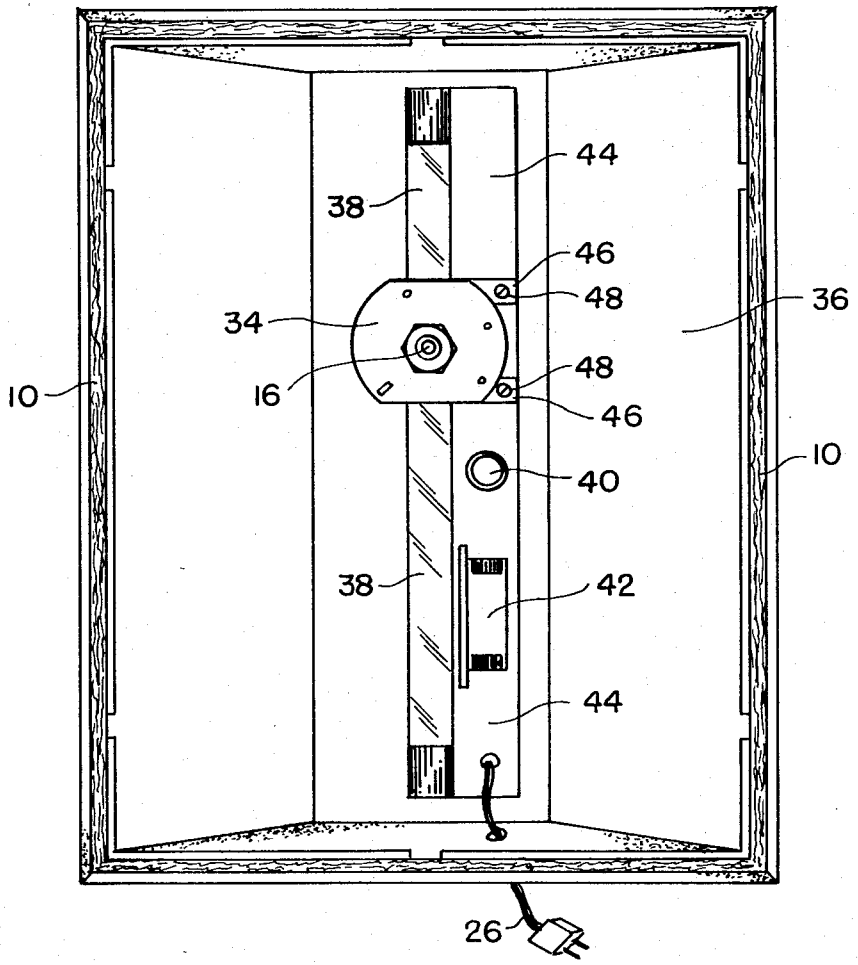
FIG. 2 is a front view, like the view of FIG. 1, but with the transparent cover and resilient panel components of the assembly being removed to reveal an illumination source which constitutes one embodiment of the invention.
Figure 3:
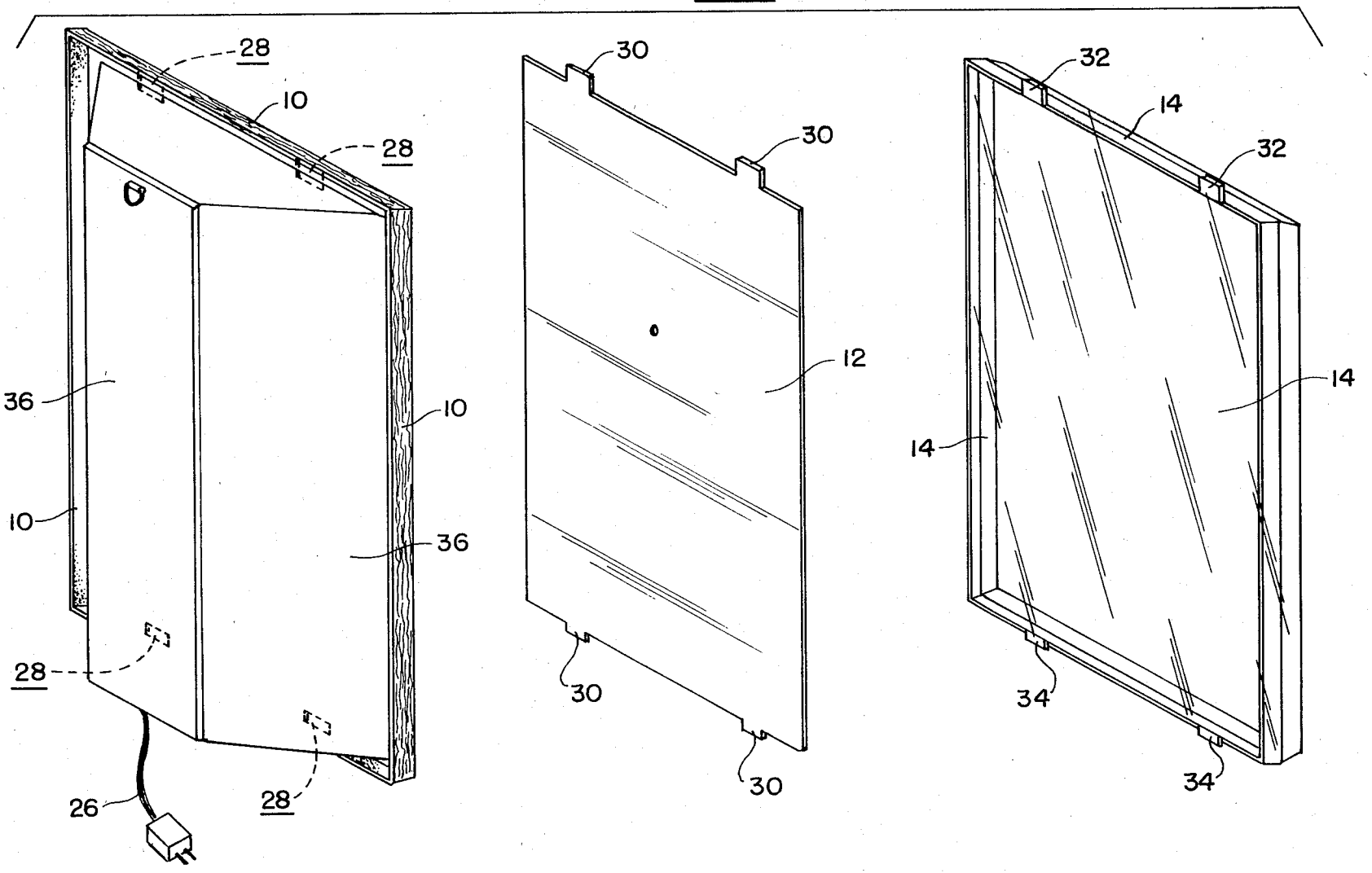
FIGS. 3 is an exploded perspective view of the embodiment of the invention of FIG. 2.

In the embodiment of FIGS. 2 and 3, the rigid panel 10 has slots 28 formed in its upper and lower edges, and the resilient panel 12 has integral lugs 30 which are received in the respective slots 28. The panel 12 is mounted in the rigid frame 10 merely by bowing the panel and causing lugs 30 to be inserted into the respective slots.

The transparent cover 14, as shown in FIG. 3 also has integral lugs 32 at its upper edge and integral lugs 34 at its lower edge. As shown, the lugs 32 are longer than the lugs 34. The lugs 32 and 34 are also received, together with lugs 30 of panel 12, in the slots 28 of the rigid frame 10.

The cover is mounted by first inserting the upper lugs 32 in the upper slots 28, and then displacing the cover 14 upwardly to permit the cover to be moved inwardly until the lugs 34 are disposed over corresponding slots 28 in the lower edge of the frame. The cover is then dropped so that the lugs 34 may be received in the lower slots 28. The cover is removed simply by displacing it upwardly with respect to the frame 10 so as to free the lugs 34, and then turning the cover outwardly so that it may be removed.

Figure 4:
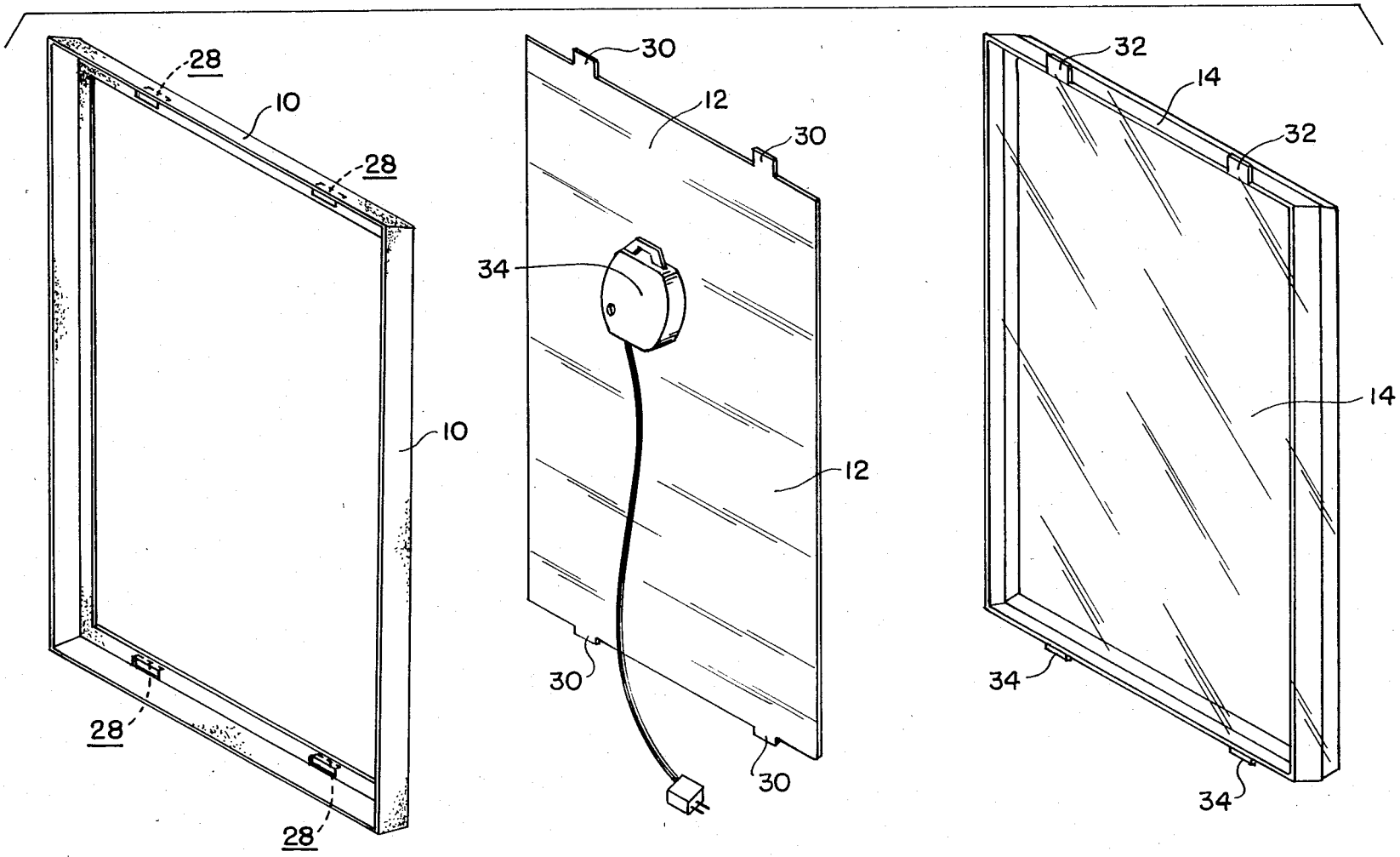
FIG. 4 is an exploded perspective view of a simplified embodiment in which the clock face is not illuminated.

As shown in FIG. 2, an electric drive motor 34 for the clock of FIG. 4 is mounted in a compartment 36 which, in turn, is mounted on the rear side of the rigid frame 10. Compartment 36 may be formed of a thin metal which is stamped into the shape shown in FIG. 3. The inner surface of the compartment may be painted white, or other appropriate color, to form a reflector.

An elongated fluorescent lamp 38 is mounted in the compartment 36, and a starter 40 and transformer 42 for the fluorescent light is mounted on a chassis 44 within the housing. Motor 34 is also mounted on chassis 44 by means of a bracket 46 which, in turn, is mounted on the chassis by appropriate screws 48. The electric cord 26 supplies power to the transformer 42, as well as to the motor 34.

In the embodiment of FIG. 4, motor 34 is directly mounted to the rear side of the resilient plastic panel 12. The embodiment of FIG. 4 is a simpler version of the clock of the invention in which the face is not illuminated.

The invention provides, therefore, a simple and inexpensive clock which is composed of three basic plastic members which are easily fitted together, and which are likewise easily disassembled from one another. The clock is constructed to be attractive, and to bear an advertising message on its face. In one embodiment, a light source is mounted behind the face of the clock, so that the face may be illuminated.

It will be appreciated that while particular embodiments of the invention have been shown and described, modifications may be made. It is intended in the claims to cover all modifications which come within the true spirit and scope of the invention.

What is claimed is:

1. A clock comprising: a rigid frame member having a plurality of slots therein at the top and bottom thereof; a thin resilient plastic panel enclosing the space circumscribed by the frame member and having integral lugs at the top and bottom edges thereof received in the slots in the frame member, said panel having clock indicia formed on the front face thereof; a transparent cover having integral lugs at the top and bottom edges thereof to be received in said slots in said frame member to mount the transparent cover on the frame member with said transparent cover extending across the front face of the panel; a clock motor mounted to the rear of the panel and having a drive shaft extending through the panel; clock hands mounted on the drive shaft in front of the panel for indicating time in conjunction with the clock indicia on the front face of the panel; the lugs at the top of the cover and the lugs at the bottom thereof being dimensioned to permit the lugs at the bottom of the cover to be freed from the slots in the bottom of the frame by displacing the cover upwardly with respect to the frame to permit removal of the cover.

2. The clock defined in claim 1, in which the clock motor is an electric motor.

3. The clock defined in claim 1, in which said frame member, said panel and said transparent cover all have a rectangular shape.

4. The clock defined in claim 1, in which the clock motor is mounted on the rear face of the panel.

5. The clock defined in claim 1, and which includes a housing mounted on the rear side of said frame, and in which said clock motor is mounted in said housing.

6. The clock defined in claim 5, in which said plastic panel is translucent, and which includes a light source mounted in said housing.

* * * * *